US006346000B1

(12) United States Patent
Orr

(10) Patent No.: US 6,346,000 B1
(45) Date of Patent: Feb. 12, 2002

(54) APPARATUS FOR INTERLOCKING STACKED COMPUTER MODULES

(76) Inventor: Tom Orr, 1300 Gulfview Woods La., Tarpon Springs, FL (US) 34689

( * ) Notice: Subject to any disclaimer, the term of this patent is extended or adjusted under 35 U.S.C. 154(b) by 0 days.

(21) Appl. No.: 09/681,580

(22) Filed: May 2, 2001

(51) Int. Cl.[7] ..... H01R 4/50
(52) U.S. Cl. ..... 439/342; 361/687
(58) Field of Search ..... 439/342, 535, 439/537, 13, 12, 31, 332, 333, 334; 248/349, 346, 344; 361/687, 688, 689, 727, 726, 690

(56) References Cited

U.S. PATENT DOCUMENTS 3,985,417 A * 10/1976 Fenton ..... 339/122
4,547,027 A * 10/1985 Scheibenreif ..... 339/8

* cited by examiner

*Primary Examiner*—P. Austin Bradley
*Assistant Examiner*—Alexander Gilman
(74) *Attorney, Agent, or Firm*—Ronald E. Smith; Smith & Hopen, P.A.

(57) ABSTRACT

Stacked computer modules are mechanically and electrically interlocked by relative rotation between a top plate of a lower module and a bottom plate of an upper module. Each module has a unique shape that identifies it as being compatible with other modules of the same shape. A pair of diametrically opposed sockets extend radially from a central hub that depends from a vent aperture formed in the bottom plate of the top unit. Upon rotation of the upper unit, these sockets respectively engage a pair of diametrically opposed plugs secured to a bottom wall of the top plate of the lower module. The interconnection of sockets and plugs provides electrical and data communication between the modules as well as a mechanical interconnection. One socket/plug combination is dedicated to power and the other socket/plug combination is dedicated to data.

12 Claims, 4 Drawing Sheets

APPARATUS FOR INTERLOCKING STACKED COMPUTER MODULES

BACKGROUND OF INVENTION

1. Field of the Invention

This invention relates, generally, to computer hardware. More particularly, it relates to means for interlocking computer modules that are stacked in a vertical array.

2. Description of the Prior Art

Vertically stacked computer modules were first disclosed in U.S. Pat. Nos. 5,909,357 and 6,073,333 to the present inventor. In that disclosure, it was taught that compatible computer modules, each dedicated to a specific function, could be vertically stacked to form a functional computer. The shape of each module indicates its compatibility with modules sharing that same shape. In this way, consumers who might otherwise not attempt to assemble a computer because they lack sufficient knowledge to choose compatible parts can insure inter-module compatibility by the simple expedient of choosing modules of a common shape.

There are numerous mechanical means that could be employed to provide the interlocking means. The mechanical means must also provide for electrical and data interconnection of the modules as well. The interlocking means should be easy to understand and easy to operate, in keeping with the original concept of a computer that can be assembled without an intimate knowledge of inter-component compatibility.

In view of the prior art considered as a whole at the time the present invention was made, it was not obvious to those of ordinary skill in the pertinent art how stacked computer modules could best be interlocked in an easy, self-evident way while providing the required electrical and data connections.

SUMMARY OF INVENTION

The longstanding but heretofore unfulfilled need for an interlocking means that provides mechanical, electrical, and data communication between stacked modules is now provided in the form of a new, useful, and nonobvious invention.

A modular computer is formed by stacking a plurality of modules in a vertical array. Each module includes a central opening so that a vertically extending bore is formed in the center of the computer when a plurality of modules are in their stacked configuration. This bore provides a vent for heat generated by the modules (each module having a dedicated CPU, as more fully disclosed in the incorporated patents) and a fan means draws the heat upwardly through the bore into the ambient environment. Although a fan means could be positioned at any operative location relative to the central bore, in a preferred embodiment the fan means surmounts the uppermost module in the stack of modules and draws air upwardly through the bore into the ambient environment.

More particularly, in a preferred embodiment, the fan means is positioned in a cap module that is in removably interlocking relation to the top wall of the uppermost module in a stack of modules. The bottom wall of the cap module has the same structure as the bottom wall of the computer modules so that it is removably interlocked with the top wall of the computer module it surmounts. The top wall of the cap module, however, is aesthetically-designed and includes no interlocking means. The cap module has the same profile as the computer modules to indicate its compatibility therewith and includes a central opening that is preferably covered by a screen that permits air flow through the center shaft of the stack of computer modules and which keeps foreign objects out of the center shaft.

Each of the computer modules includes a top wall adapted to be removably interlocked with the bottom wall of a contiguous module that is stacked thereatop. Thus, each module has a bottom wall like that of all the other modules and each module has a top wall like that of all the other modules.

A primary object of the invention is to provide a durable and reliable apparatus for interlocking stacked computer modules.

Another important object is to provide an interlocking means the operation of which is intuitive so that consumers can employ it with a minimum of instruction.

Another object is to provide an interlocking means that delivers both power and data to a computer module.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
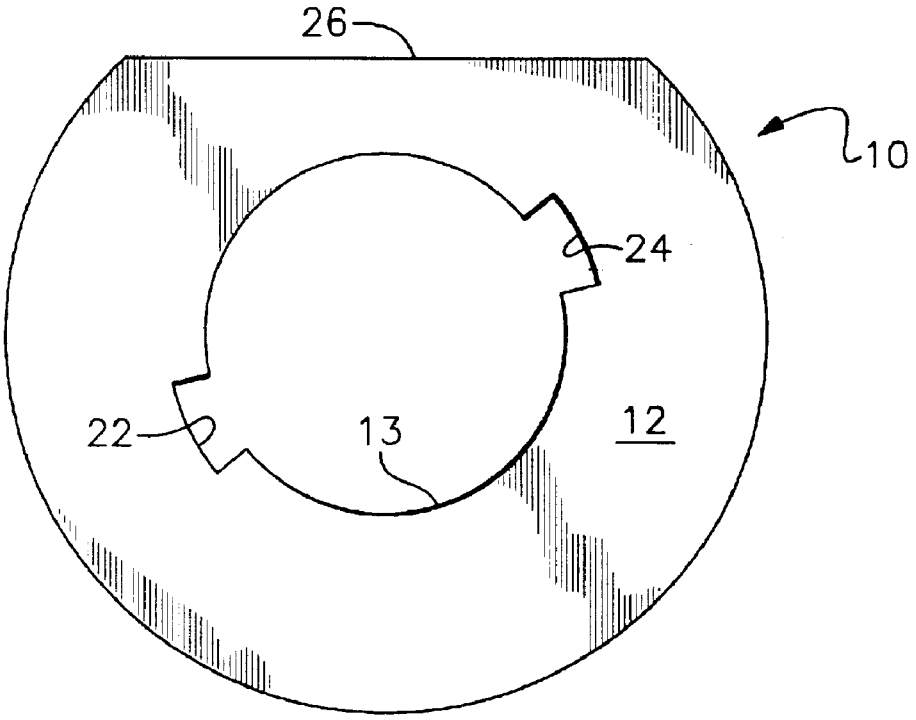
FIG. 1 is a plan view of the top wall of the bottom plate of the novel interconnecting means.
Figure 2:
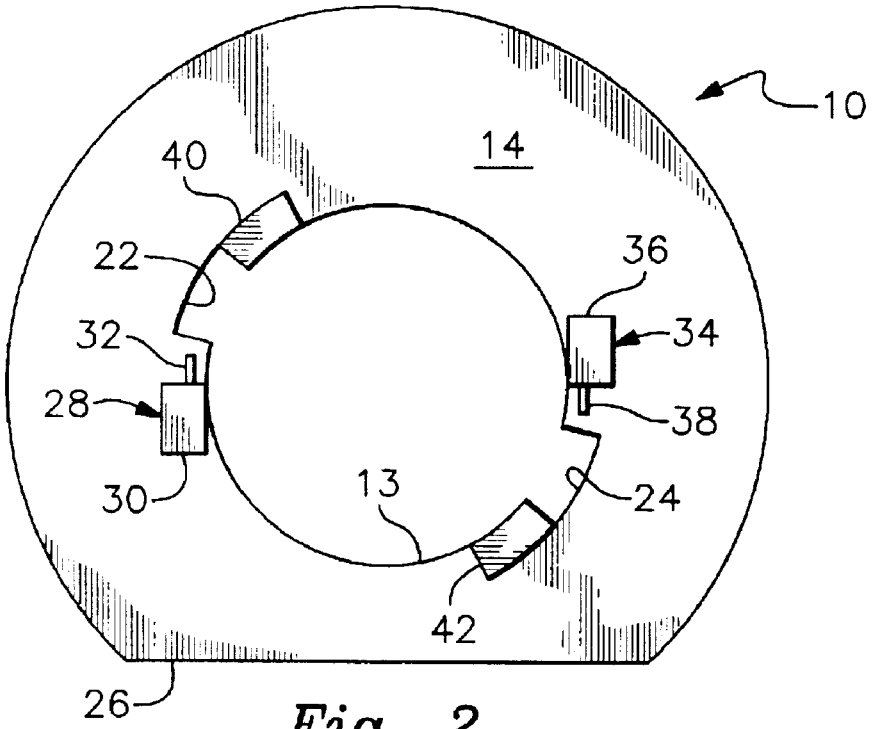
FIG. 2 is a plan view of the bottom wall of said bottom plate.
Figure 3:
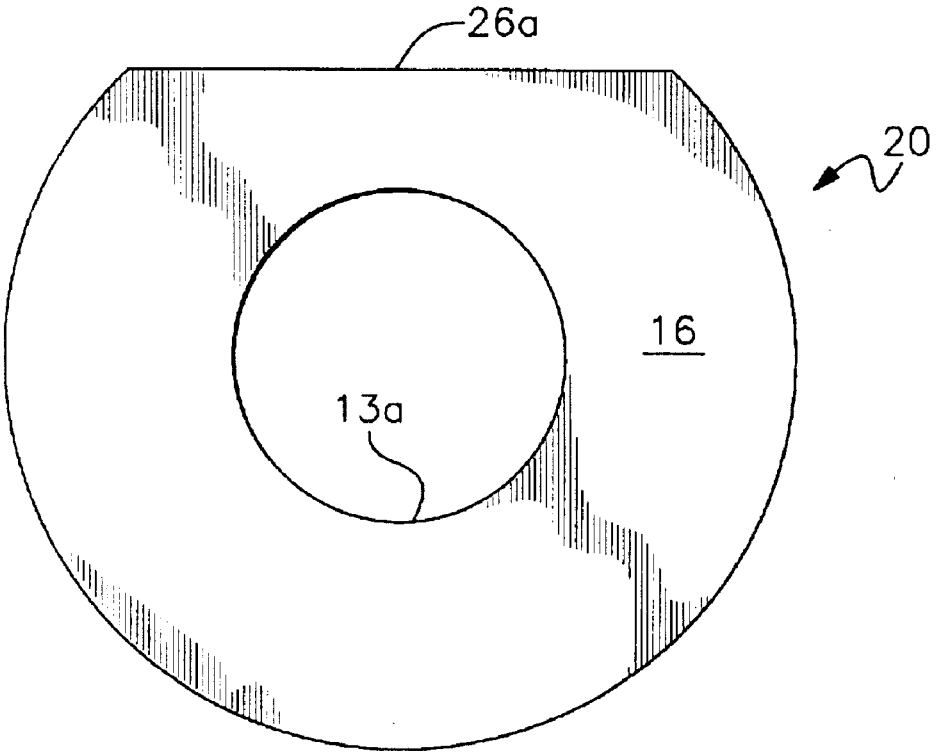
FIG. 3 is a plan view of the top wall of the top plate of the novel interconnecting means.
Figure 4:
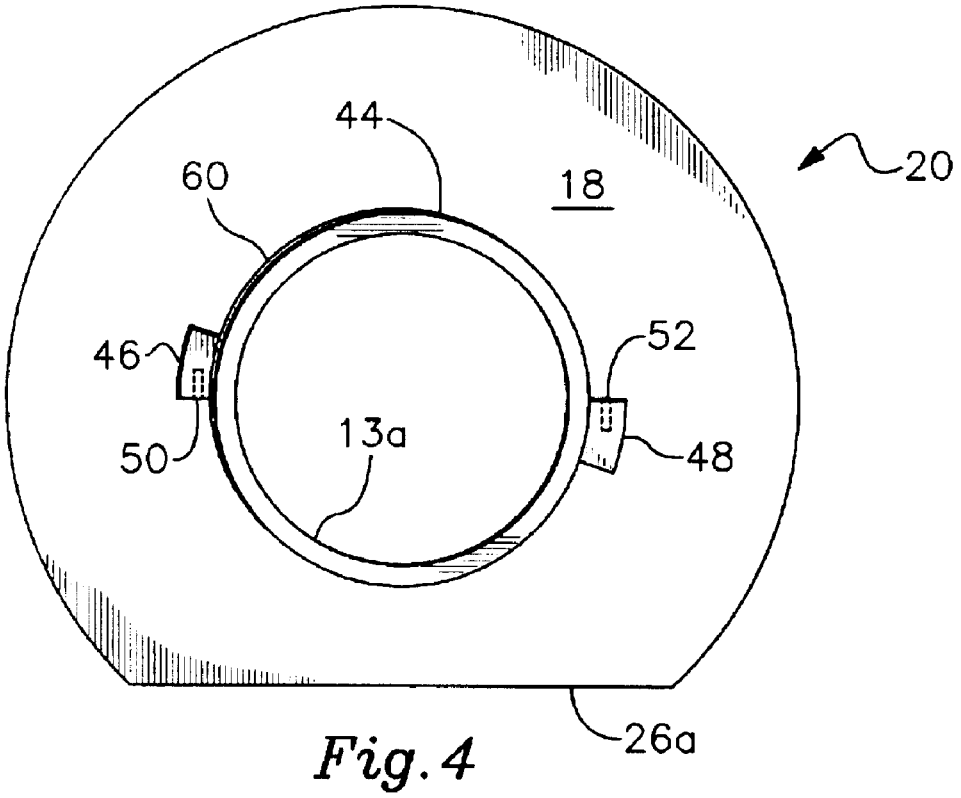
FIG. 4 is a plan view of the bottom wall of said top plate.

FIGS. 1 and 2 disclose top wall 12 and bottom wall 14, respectively, of the top plate 10 of a stackable computer module of the type disclosed in U.S. Pat. Nos. 5,909,357 and 6,073,333 to the present inventor. The respective disclosures of said patents are hereby incorporated by reference into this disclosure. FIGS. 3 and 4 respectively disclose the top wall 16 and bottom wall 18 of the bottom plate 20 of such a stackable computer module. Each wall of each plate will be described independently and the method of interconnecting the bottom plate of a top module to the top plate of a bottom module will become clear.

As depicted in FIG. 1, a central aperture 13 is formed in top wall 12. Two diametrically opposed recesses or cut-outs 22, 24 are formed in said top wall 12 in open communication with said central aperture. In this particular embodiment, top wall 10 has a generally circular configuration with a flat section 26 formed therein. Any other predetermined geometrical configuration is within the scope of this invention.

Bottom wall 14 of top plate 10 of a bottom computer module includes two diametrically opposed electrical plugs 28, 30 that are securely mounted to bottom wall 14. One of the plugs is dedicated to power and the other is dedicated to data. Power plug 28 includes housing 30 and rigid conductor 32. Data plug 34 includes housing 36 and rigid conductor 38. Each plug is mounted in circumferentially spaced apart relation to cut-outs 22 and 24. Moreover, each plug is mounted adjacent to and flush with central aperture 13. Conductor 32 extends from housing 30 in a first direction tangent to said central opening and conductor 38 extends from housing 36 in an opposite direction tangent to said central opening.

Two diametrically opposed stops 40, 42 are secured to bottom wall 14 in circumferentially adjacent relation to cut-outs 22, 24, respectively.

Top wall 16 of the bottom plate 20 of a top computer module is depicted in FIG. 3. Central opening 13*a* and flat edge 26*a* are formed therein.

FIG. 4 depicts bottom wall 18 of said bottom plate 20. Cylindrical alignment member or hub 44 is mounted about the periphery of central aperture 13*a*. As best understood in connection with FIG. 6, hub 44 depends from said central aperture. Significantly, hub 44 has a vertical extent or thickness substantially equal to three times the vertical extent or thickness of top plate 10 or bottom plate 20.

It should be noted at this point that central aperture 13*a* of bottom plate 20 has a diameter that is less than a diameter of central aperture 13 of top plate 10. Hub 44 is therefore slideably received within central aperture 13 when the top and bottom plates are interconnected in the manner hereinbelow set forth.

A pair of substantially diametrically opposed socket housings 46, 48 are secured to said hub and extend radially therefrom. Each socket housing includes an internal socket 50, 52 that slideably receives and electrically communicates with conductors 32, 38 (FIG. 2) when the computer modules are interconnected to one another.

Figure 6:
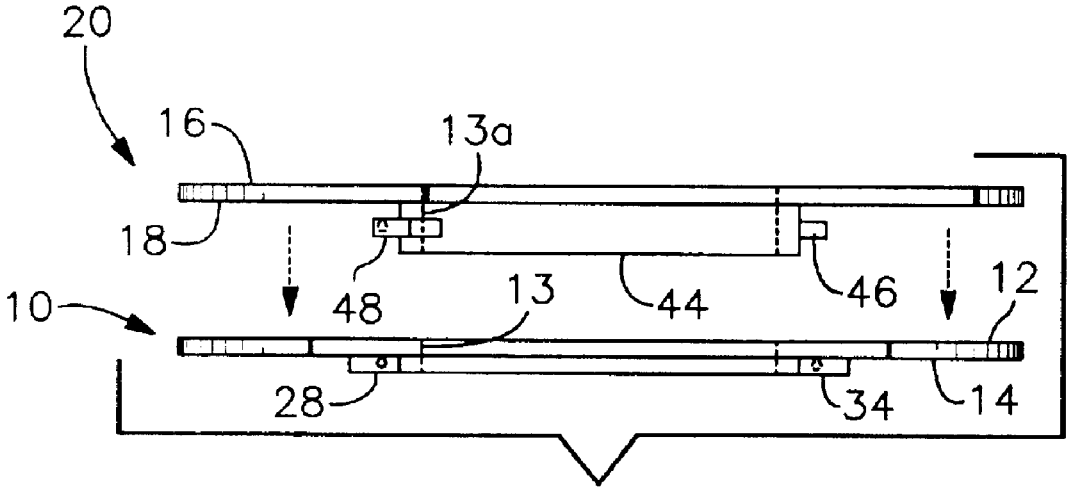
FIG. 6 is a side elevational view taken along line 6—6 in FIG. 5.

Note from FIG. 6 that each socket housing 46, 48 is positioned mid-length of hub 44, i.e., said housings are spaced from bottom wall 18 of top plate 20 by a distance slightly greater than the thickness of bottom plate 10.

Figure 5:
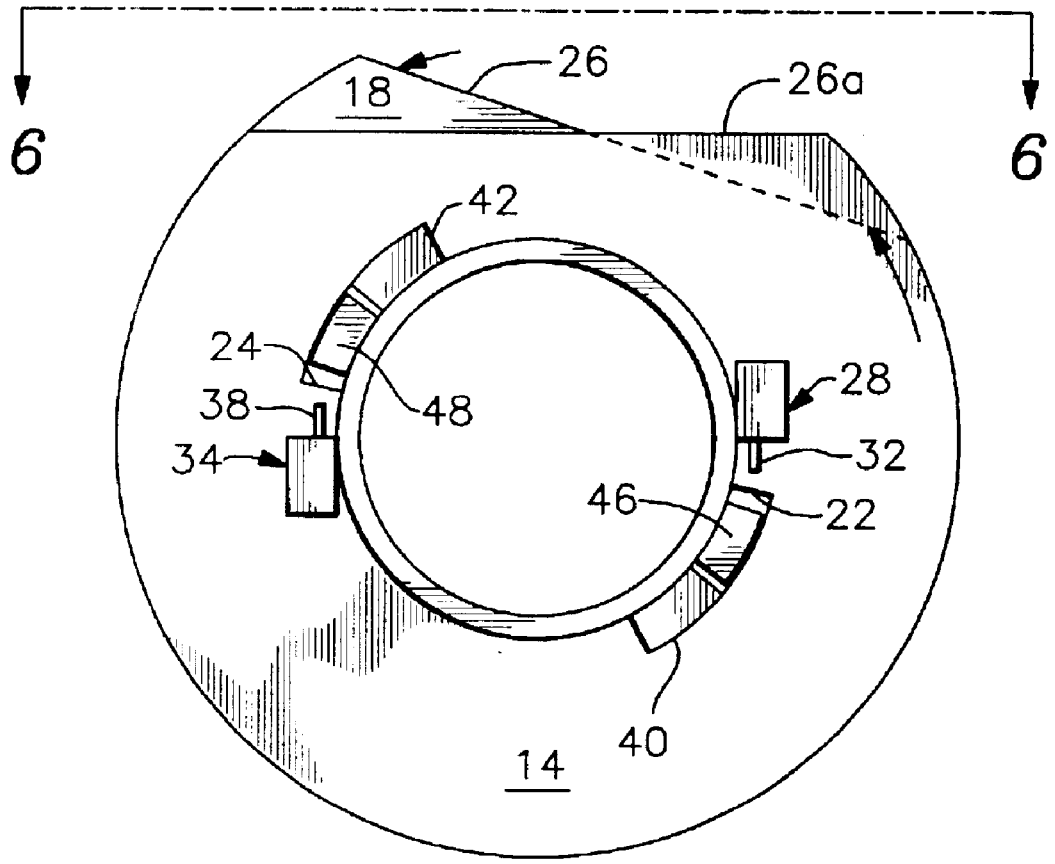
FIG. 5 is a plan view of the bottom wall of the top plate of a lower module positioned in underlying relation to the bottom wall of an upper module.

The interconnection process is perhaps best understood by comparing FIGS. 5 and 6 to one another. Bottom plate 20 of an upper computer module is positioned in concentric alignment with top plate 10 of a lower computer module in overlying relation thereto and said bottom plate 20 is rotated counterclockwise until socket housings 46, 48 of bottom plate 20 are aligned with cut-outs 22, 24 of top plate 10. Hub 44 is then inserted through central opening 13 until bottom wall 18 of bottom plate 20 abuts top wall 12 of top plate 10. Further rotation of top plate 20 in a counterclockwise direction is prevented because stop members 40 and 42 are disposed in abutting relation to socket housings 46, 48. Moreover, when closing the lid on a jar or when turning a screw, clockwise rotations are made. Thus, in addition to counterclockwise rotation being prevented by the abutment of said socket housings and stop members as aforesaid, it is intuitive to rotate the upper computer module and hence bottom plate 20 in a clockwise direction to accomplish interlocking of the top and bottom modules. Such clockwise rotation is indicated in FIG. 5 by a pair of single-headed directional arrows that appear as counterclockwise arrows because the view is looking upwardly from the bottom module, rotates the socket housings 46, 48 into abutting relation to plug housings 30, 36. This rotation causes conductors 32, 38 to enter into electrical communication with sockets 50, 52, respectively. This brings the electrical power bus and the data bus of the upper and lower modules into communication with one another and hence with the other modules in the stack, if any.

Moreover, such rotation also misaligns socket housings 46, 48 and cut-outs 22, 24, thereby providing a strong mechanical interlocking that supplements the mechanical interlocking achieved by the mating of the conductors and sockets.

Figure 7:
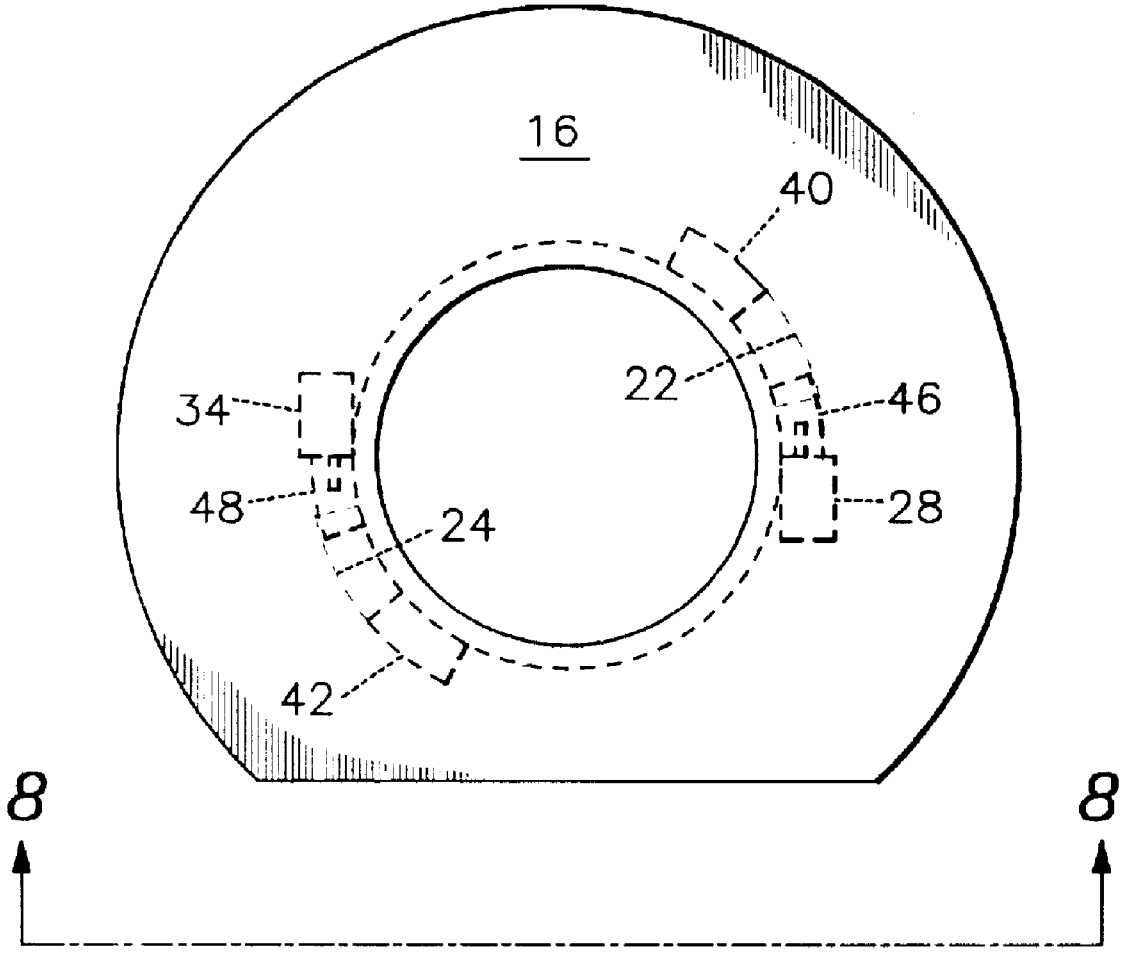
FIG. 7 is a plan view of the top and bottom plates when they are interlocked to one another.
Figure 8:
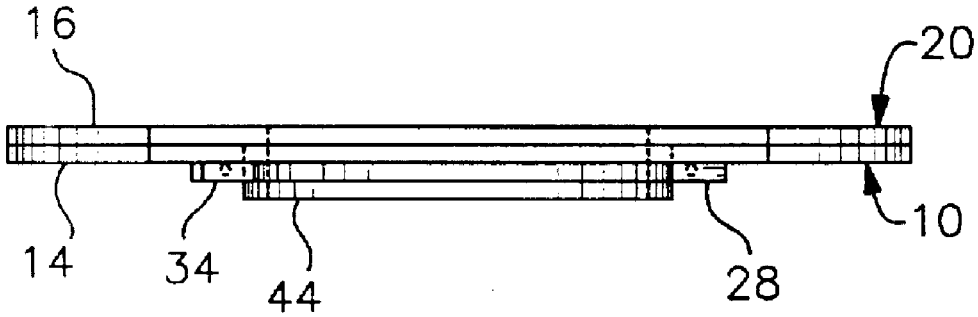
FIG. 8 is a side elevational view of the top and bottom plates when they are interlocked to one another, taken along line 8—8 in FIG. 7.

FIGS. 7 and 8 depict the top and bottom plates when interlocked.

Separation of the interlocked modules is achieved simply by reversing the interconnecting process.

Such clockwise rotation to attach a new computer module is intuitive because it matches the standard rotation required to tighten a right-handed screw or to turn off a faucet. When it is desired to remove a computer module or to replace with it with an improved module, it is equally intuitive to rotate it counterclockwise.

Annular ridge 60 extends radially outwardly a predetermined extent along a predetermined circumferential extent of hub 44. Said ridge 60 is positioned about one-third the distance from the leading, free end of the hub. The radial extent of ridge 60 is sufficient to prevent full entry of hub 44 into central aperture 13 when the upper and lower computer modules are misaligned. In this way, a user may position an upper computer module in any rotational position relative to a lower computer module. The top module is then rotated and said top module falls into place, i.e., hub 44 fully enters into central aperture 13, when the end of ridge 60 is encountered. (Tom: Is aperture 13 out-of-round so that it accepts hub 44 in only one rotational position?).

It should also be understood that annular ridge 60 is an optional feature of the novel assembly. The rotational interconnection of computer modules disclosed herein is fully operative without said ridge 60.

When hub 44 has fully entered central aperture 13, bottom plate 20 of the upper computer module is rotated clockwise until straight edges 26, 26*a* line up with one another. The plugs enter their respective sockets when the straight edges line up. In this way, both power and data are delivered to the newly added (upper) computer module, it being understood that the lower computer module and all computer modules atop which it is stacked are in similar electrical and data communication prior to the addition of the upper module to the stack.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An interlocking means for rotationally interlocking contiguous modules in a vertical stack of computer modules, comprising:

a top plate adapted to form the uppermost part of each computer module in said vertical stack of computer modules;

a bottom plate adapted to form the lowermost part of each computer module in said vertical stack of computer modules;

a bottom plate of a second computer module disposed in overlying relation to a top plate of a first computer module when said second computer module is disposed in overlying relation to said first computer module;

a bottom plate of a third computer module disposed in overlying relation to a top plate of said second computer module when said third computer module is disposed in overlying relation to said second computer module;

said top and bottom plates having a configuration in common with said respective first, second, and third computer modules when viewed in plan view so that said configuration of said computer modules ensures inter-module compatibility;

mechanical means for mechanically interlocking contiguous top plates and bottom plates to one another by relative rotation therebetween;

said mechanical means including first electrical means providing electrical communication between contiguous computer modules;

said mechanical means further including second electrical means providing data communication between said contiguous computer modules;

each top plate of each of said computer modules in said vertical stack having a top plate vent opening formed centrally thereof for cooling air to flow through; and each bottom plate of each of said computer modules in said vertical stack having a bottom plate vent opening formed centrally thereof for cooling air to flow through.

2. The interlocking means of claim 1, further comprising:

a first and second substantially diametrically opposed cut out formed in each of said top plates, each of said first and second cut-outs being in open communication with each top plate vent opening.

3. The interlocking means of claim 1, wherein each of said top plates includes a top wall and a bottom wall, and wherein said first electrical means includes an electrical plug housing secured to said bottom wall of each top plate, said electrical plug housing being mounted in circumferentially spaced apart relation to said first cut out and in contiguous relation to said top plate vent opening.

4. The interlocking means of claim 3, further comprising a pair of stop members secured to said bottom wall of each top plate, each stop member of said pair of stop members being positioned in contiguous circumferential relation to said cut-outs formed in each top plate.

5. The interlocking means of claim 3, wherein said second electrical means includes a data plug housing secured to said bottom wall of each of said top plates, said data plug housing being mounted in circumferentially spaced apart relation to said second cut out, in contiguous relation to said top plate vent opening, and in substantially diametrically opposed relation to said first electrical means.

6. The interlocking means of claim 5, further comprising a hub that depends from a bottom wall of each of said bottom plates, said hub circumscribing each bottom plate vent opening and being slideably received within each top plate vent opening when a plurality of said computer modules are vertically stacked.

7. The interlocking means of claim 6, wherein each top plate has a predetermined thickness and wherein each hub has a longitudinal extent substantially equal to about three times said predetermined thickness of each top plate.

8. The interlocking means of claim 7, further comprising an electrical socket means secured to each hub, said electrical socket means being positioned mid-length of each hub.

9. The interlocking means of claim 8, wherein said electrical socket means and said data socket means are respectively sized to pass through said cut-outs when each hub is inserted through each top plate vent opening.

10. The interlocking means of claim 8, further comprising a data socket means secured to each hub, said data socket means being positioned mid-length of each hub in substantially diametrically opposed relation to said electrical socket means.

11. The interlocking means of claim 10, further comprising a ridge that extends radially from each hub along a predetermined circumferential extent thereof, said ridge preventing reception of each hub by said top plate vent opening until said electrical socket means and data socket means are in rotational alignment with said first and second cut-outs.

12. An interlocked assembly of contiguous computer modules in a vertical stack of computer modules, comprising:

a bottom plate of a second computer module disposed in abutting, overlying relation to a top plate of a first computer module;

a bottom plate of a third computer module disposed in abutting, overlying relation to a top plate of said second computer module;

each bottom plate having a bottom plate vent opening formed therein and having a hub depending from a peripheral edge of each bottom plate vent opening;

a pair of socket members mounted to each hub in substantially diametrically opposed relation to one another, each socket member of said pair of socket members extending radially outwardly with respect to each hub;

each top plate having a top plate vent opening formed centrally thereof and having a pair of substantially diametrically opposed first and second cut-outs formed in a peripheral edge of said vent opening;

each bottom plate and each top plate sharing a geometric shape in common with each computer module in said vertical stack of computer modules when viewed in plan view so that said geometric shape of said computer modules indicates inter-module compatibility;

said geometric shapes being in rotational alignment with one another when said computer modules are interlocked to one another and being in rotational misalignment with one another when said computer modules are not interlocked with one another;

a pair of plug members mounted to a bottom wall of each top plate, said pair of plug members being substantially diametrically opposed to one another and being mounted contiguous to each top plate vent opening;

said pair of plug members and said pair of socket members being respectively engaged to one another when each of said top plate and bottom plate are rotationally engaged to one another;

each pair of plug members and each pair of socket members being misaligned with said first and second cut-outs when each of said top plates and bottom plates are rotationally engaged to one another such that their respective geometric configurations match;

whereby more than two computer modules are vertically stackable and mechanically interlockable to one another;

whereby each module in a vertical stack is electrically interconnected with each other module in the stack;

whereby the stack of modules is cooled by a common central vent extending the height of the stack; and whereby inter-module compatibility is indicated by a common configuration shared by said modules.

* * * * *